US006782676B2

(12) United States Patent
Guillou

(10) Patent No.: US 6,782,676 B2
(45) Date of Patent: Aug. 31, 2004

(54) METHOD AND DEVICE FOR PACKING A SOLID INTO A CONTAINER SUCH AS A BOTTLE

(75) Inventor: Denis Guillou, Caorches Saint Nicholas (FR)

(73) Assignee: Ducros, Carpentras Cedex (FR)

( * ) Notice: Subject to any disclaimer, the term of this patent is extended or adjusted under 35 U.S.C. 154(b) by 0 days.

(21) Appl. No.: 10/149,245

(22) PCT Filed: Dec. 8, 2000

(86) PCT No.: PCT/FR00/03460

§ 371 (c)(1),
(2), (4) Date: Oct. 10, 2002

(87) PCT Pub. No.: WO01/42086

PCT Pub. Date: Jun. 14, 2001

(65) Prior Publication Data

US 2003/0101689 A1 Jun. 5, 2003

(30) Foreign Application Priority Data

Dec. 9, 1999 (FR) ..... 99 15554

(51) Int. Cl.[7] ..... B65B 31/02

(52) U.S. Cl. ..... 53/432; 53/485; 53/87; 53/89

(58) Field of Search ..... 53/87, 88, 89, 53/432, 485, 490, 287, 317, 405, 426, 510

(56) References Cited

U.S. PATENT DOCUMENTS

| | | | | | |
|---|---|---|---|---|---|
| 1,920,240 | A | * | 8/1933 | Brady | 53/84 |
| 2,338,852 | A | * | 1/1944 | Hohl et al. | 53/302 |
| 2,496,877 | A | * | 2/1950 | Krueger | 53/405 |
| 2,510,457 | A | * | 6/1950 | Bjering | 53/76 |
| 2,510,568 | A | * | 6/1950 | Fouse | 53/88 |
| 2,610,779 | A | | 9/1952 | Fouse | |
| 3,149,649 | A | * | 9/1964 | Hix | 141/93 |
| 3,169,355 | A | * | 2/1965 | Hollaway et al. | 53/88 |
| 3,220,153 | A | | 11/1965 | Cormack, Jr. et al. | |
| 3,255,568 | A | * | 6/1966 | Martin et al. | 53/95 |
| 3,299,607 | A | * | 1/1967 | Dopp et al. | 53/87 |
| 3,334,467 | A | * | 8/1967 | Bjering et al. | 53/88 |
| 3,786,614 | A | | 1/1974 | Mistarz | |
| 3,905,177 | A | * | 9/1975 | Herzog | 53/314 |
| 4,003,186 | A | * | 1/1977 | van Rede | 53/88 |
| 4,140,159 | A | * | 2/1979 | Domke | 141/129 |
| 4,388,795 | A | * | 6/1983 | Stohlquist et al. | 53/435 |
| 4,658,566 | A | * | 4/1987 | Sanfilippo | 53/432 |
| 4,771,903 | A | * | 9/1988 | Levene et al. | 215/232 |
| 5,195,298 | A | * | 3/1993 | Baranowski | 53/425 |
| 5,417,255 | A | * | 5/1995 | Sanfilippo et al. | 141/1 |

FOREIGN PATENT DOCUMENTS

| | | |
|---|---|---|
| EP | 0 022 084 | 1/1981 |
| EP | 0 351 594 | 1/1990 |
| FR | 2 290 356 | 6/1976 |
| FR | 2 394 452 | 1/1979 |
| GB | 2 322 851 | 9/1998 |
| WO | 94 25 347 | 11/1994 |

* cited by examiner

*Primary Examiner*—Stephen F. Gerrity
*Assistant Examiner*—Paul R Durand
(74) *Attorney, Agent, or Firm*—Young & Thompson

(57) ABSTRACT

A bell-shaped element is placed in a sealed position whereby it rests against the outer wall of the container which is full of solid commodities in order to create a partial vacuum in the inner area of said bell-shaped element and in the gaseous area of the container. A sealing armature subsequently places a sealing cap on top of the opening of the container. When the vacuum is created, a cleanliness element rests against the free edge of the opening of the container in a position which is sealed by means of a liner. The cleanliness element comprises a sieve which retains solid materials inside the container during suction. The cleanliness element subsequently retracts on a plane of its own, wiping the free end of the opening in order to remove debris and solid particles which could prevent the opening from being sealed in a desired manner.

16 Claims, 2 Drawing Sheets

METHOD AND DEVICE FOR PACKING A SOLID INTO A CONTAINER SUCH AS A BOTTLE

The present invention relates to a method for packing a solid, in particular a foodstuff into a container such as a bottle.

The present invention also concerns a device to that effect.

A more particular subject of the invention is to perfect the packing of solid foodstuffs in powder, grains or granules, in leaves, fragmented or non-fragmented, or also constituted by berries or fruits, with the aim of better preserving them, in particular with respect to their aromatic quality.

The creation of a vacuum or a controlled atmosphere in a container above the liquid contained within it, before sealing the container is known from a number of documents, for example FR-A-2 290 356, WO-A-94 25 347, FR-A-2 394 452, EP-A-0 022 084, GB-A-2 322 851, and U.S. Pat. No. 4,658,566. In the majority of cases, a bell-shaped element is placed around the upper region of the container. The free edge of the bell-shaped element carries a sealing element which presses on the outer wall of the container in such a way as to create inside the bell-shaped element a vacuum chamber which communicates with the interior of the container via its filling opening. Part of the air which it contains is evacuated from the bell-shaped element, and in particular the air found in the container above the level of the liquid. After creation of the desired partial vacuum, a sealing device provided in the bell-shaped element is used to place an appropriate sealing cap over the opening of the container. The sealed container is then extracted from the bell-shaped element then taken to the next handling station. During this time, the sealing device is re-supplied with a new cap and a new container to be sealed is placed in the bell-shaped element.

Documents U.S. Pat. No. 2,496,877 and U.S. Pat. No. 3,222,153 propose the application of vacuum packing to solid substances such as powdered coffee. To avoid the powder being aspirated at the same time as the air during creation of the partial vacuum, a sieve mounted in a ring which is applied to the free edge of the neck of the container is placed over the opening of the container. However, it should be noted that, in practice, solid particles or debris from the filling substance have a tendency to rest on the surface of the container which is intended to create a seal with the cap. This surface is in principle constituted by the free peripheral edge of the neck of a container manufactured in the form of bottle. Such debris or particles then have the effect of preventing the tight seal of the bottle, or in any case of shortening the life expectancy of the seal.

The purpose of the present invention is more particularly to remedy this specific problem of vacuum packing solids in containers such as bottles.

According to a first aspect of the invention, the method for packing a solid substance, in particular a foodstuff, presented at least in part in the form of powder, grains, whole or fragmented leaves, berries, small fruits and the like into a container such as a bottle, a method in which after filling the container, when the container has been placed in an enclosure under vacuum, part of the air which is initially present in it is evacuated from this enclosure, and from the container via its opening, then the container is sealed, characterized in that after said evacuation and before said sealing the free edge of the opening is wiped to clear it of any fragments originating in particular from said substance.

This wiping makes it possible to eliminate from the free edge particles or other debris that could have settled there either during filling or following it.

It is particularly advantageous to use a protection ring which is placed on the free edge of the opening during evacuation of the air from the enclosure as a means of wiping.

This protection ring prevents debris or particles from settling on the free edge of the opening during the suction process.

After evacuation and before sealing the ring is moved from its active position on the free edge of the opening to a retracted position approximately situated in the plane of said free edge to carry out wiping.

Moreover the aforementioned ring can be used as a mount for a sieve.

According to a second aspect of the invention, the device for sealing a container such as a bottle under vacuum, for the implementation of the method according to the first aspect, comprising:

- a vacuum bell-shaped element combined with a means of suction;
- a support for the container;
- means of relative displacement between the bell-shaped element and the support between an open position allowing the delivery of a new container to be sealed and a closed position in which a tight enclosure is created in the bell-shaped element communicating with the interior of the container via an opening in the container;
- a means of sealing taken into the bell-shaped element opposite the opening;
- a cleanliness element which is moveable inside the bell-shaped element between an active position adjacent to the free edge of the opening of the container when the bell-shaped element is in the closed position, and a retracted position allowing sealing,
- is characterized in that the cleanliness element comprises an element for wiping the free edge of the opening before sealing.

The cleanliness element can for example be a wiper similar to a car windscreen wiper, or also preferably, as mentioned above, a ring. Advantageously the ring is found opposite the opening of the container when it is in the process of being attached to the bell-shaped element, and simply comes to bear axially against the free edge of the opening at the same time as the bell-shaped element reaches the closed position. In this way, the ring can press considerably on the free edge without at any time having to "mount" the free edge by a wiping movement which goes from the retracted position to the position of contact with the free edge. The only wiping movement is that which goes from the position of contact with the free edge to the retracted position. Wear on the wiping ring is thus minimized.

Other features and advantages of the invention also emerge from the description below, which relate to non-limiting examples.

Figure 1:
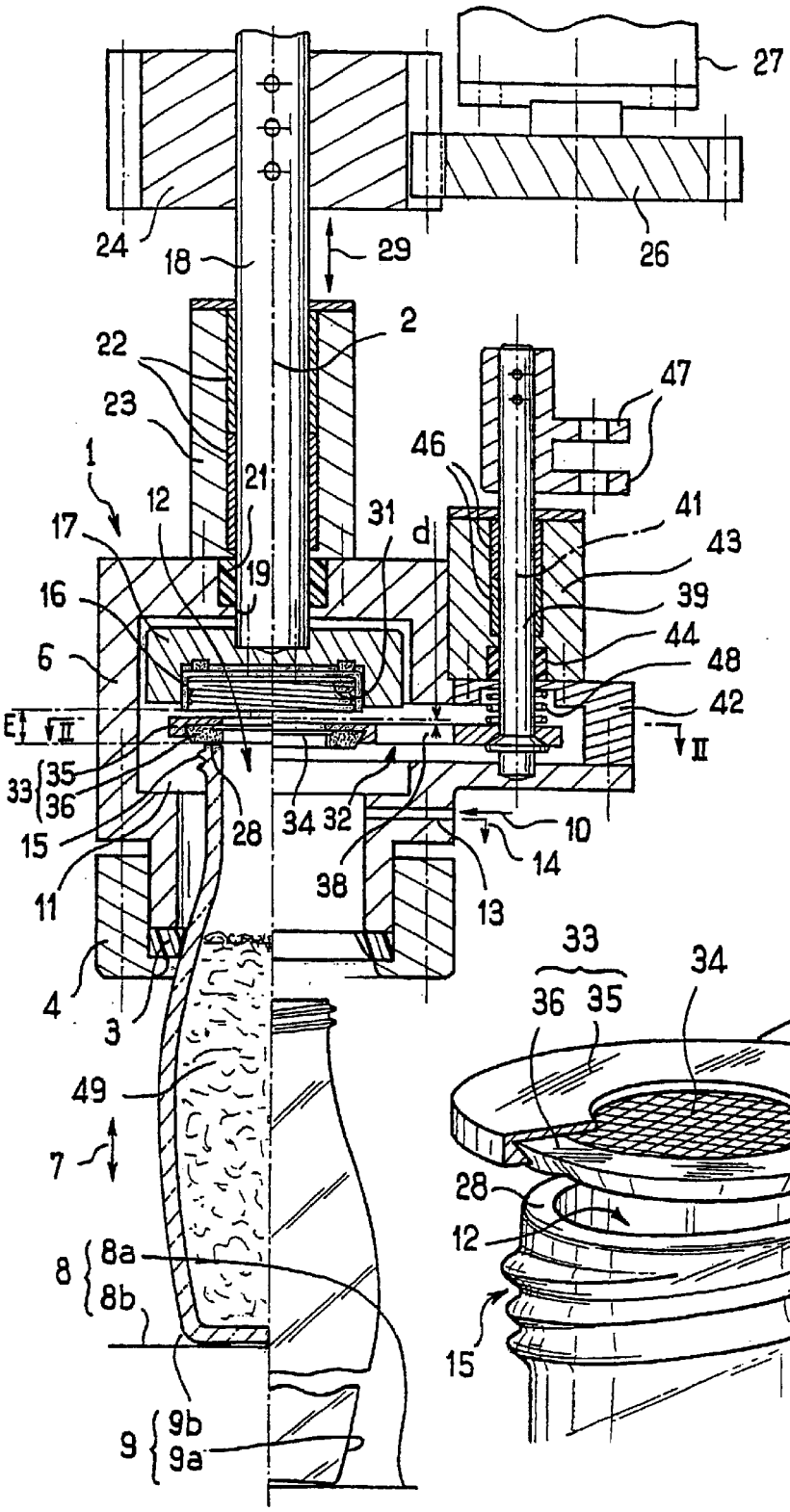
FIG. 1 is a vertical cross section of the device according to the invention, in two successive stages of the implementation of the process, represented either side of the axis of the bottle.

As shown in FIG. 1, the device according to the invention comprises a bell-shaped element 1, with a vertical axis 2. The bell-shaped element 1, open at the bottom, has on its circumference near its free edge an annular seal 3. The axial clamping of seal 3 and consequently its expansion towards the axis 2 can be adjusted by means of an adjustable axial compression ring 4 associated with the body 6 of the bell-shaped element 1. By means which are not illustrated except by a double vertical arrow 7, the bell-shaped element 1 and the elements that it carries, which are yet to be described, are adjustable in height with respect to a support 8 for the containers 9 to be vacuum-sealed.

In the example represented, it is support 8, of which a extreme lower position 8*a* and an extreme upper position 8*b* are represented in FIG. 1, which can be displaced vertically to establish the aforementioned vertical movement according to arrow 7, but it is only a convenient means of illustration, displacement of the bell-shaped element 1 with respect to the vertically fixed support 8 is also conceivable.

In position 8*a*, where the distance between the bell-shaped element 1 and the support 8 is at a maximum, the bell-shaped element is in an open situation, and a horizontal relative movement between the bell-shaped element 1 and the support allows a container 9, filled with the solid goods to be packed, to be placed under the bell-shaped element 1 in the position represented where the axis of the container coincides with axis 2 of the bell-shaped element. By movement according to arrow 7, the support 8 can be raised to position 8*b* in which seal 3 presses tightly against the outer peripheral wall of the container 9 which in the represented example is a relatively small glass bottle for example about 10 centimeters high. This tight pressing defines inside the bell-shaped element 1 a vacuum chamber 11 which communicates with the inside of container 9 via the upper filling opening 12 of the latter. In order to create the partial vacuum in chamber 11 and in the gaseous area of container 9, the body 6 of the bell-shaped element 1 comprises an opening 13 connecting with a vacuum source symbolized by arrow 14. An arrow 10 in the opposite direction illustrates that opening 13 can also be used when sealing is finished to eject the sealed container 9 from the bell-shaped element 1 and thus overcome, when needed, possible adherence between the container 9 and the seal 3.

The vacuum-sealing device moreover comprises a sealing device. In the example represented, it concerns a device for placing a screw cap 16, by screwing onto an exterior screw thread 15 of the neck of the container 9. The cap or screw cap 16 is preferably metallic and the sealing device comprises inside the bell-shaped element 1 a sealing armature 17. Before the arrival of a container 9 to be sealed in the bell-shaped element 1, non-represented means, known in themselves, provide the armature 17 with a new cap. The armature 17 comprises permanent magnets, non-represented, which retain the cap in suspension above the opening 12 of the container 9 to be sealed.

The armature 17 is integral with a shaft 18 that extends towards the top via a bore 19 provided axially in the body 6 of the bell-shaped element and provided with a seal 21. The shaft 18 is supported in rotation relative to the bell-shaped element 1 in sliding bearings 22 mounted in a tubular support 23 fixed to the upper face of the body 6 around the bore 19. Beyond the tubular support 23, the shaft 18 is fixed to a driving pinion 24 engaged with a drive pinion 26 integral with the shaft of a servomotor 27. In the situation represented in FIG. 1, the moveable assembly constituted by the shaft 18, the armature 17 and the pinion 24 is in a position of readiness where a free area E is maintained between the armature 17 and the cap 16 on one side, and the free edge 28 of the opening 12 of the container 9 on the other when the bell-shaped element 1 is in a closed position. Starting from this position of readiness, said assembly 18, 17, 24 can be moved along axis 2 (arrow 29 in FIG. 1) by a non-represented means such as a vertical jack, to a sealing position represented in FIG. 4. During this movement, the teeth of the driving pinion 24 slide axially with respect to the teeth of drive pinion 26. Then the servomotor 27 is actuated so as to screw on the cap 16 onto the screw thread 15, while the axial movement following arrow 29 continues because of the axial component of the helicoidal screwing motion. The axial dimension of the driving pinion 24 is envisaged to be sufficiently large for pinions 24 and 26 to remain in contact throughout the axial travel, of the assembly 18, 17, and 24.

Once sealing has been carried out, assembly 17, 18, 24 is returned to the position of readiness with a force which causes separation between the armature 17 and the cap 16 now fixed onto the container 9. The cap used comprises, on the innner face of its bottom, a sealing element 31 which at the end of, being screwed on becomes applied in a tight manner against the free edge 28 of opening 12.

The device according to the invention comprises moreover a cleanliness element 32 comprising a ring 33 serving as a mount for a sieve 34 occupying all of the opening area of the ring. The ring 33 comprises a rigid body 35 and on its lower face an annular element 36 pressing in an approximately tight manner against the free edge 28 of the opening 12 of the container 9. As FIGS. 3 and 5 also show, the sealing element 36 is trapped in a recess 37 of the body 35, the peripheral wall of the recess 37 being an undercut with a conicity corresponding to that of the outer peripheral face of the sealing element 36. The sieve 34, for example a metallic sieve, is mounted between the body 35 and the sealing element 36, and is trapped there due to the fact that its diameter is greater than that of the circular opening of the body 35 and of the sealing element 36.

Figure 4:
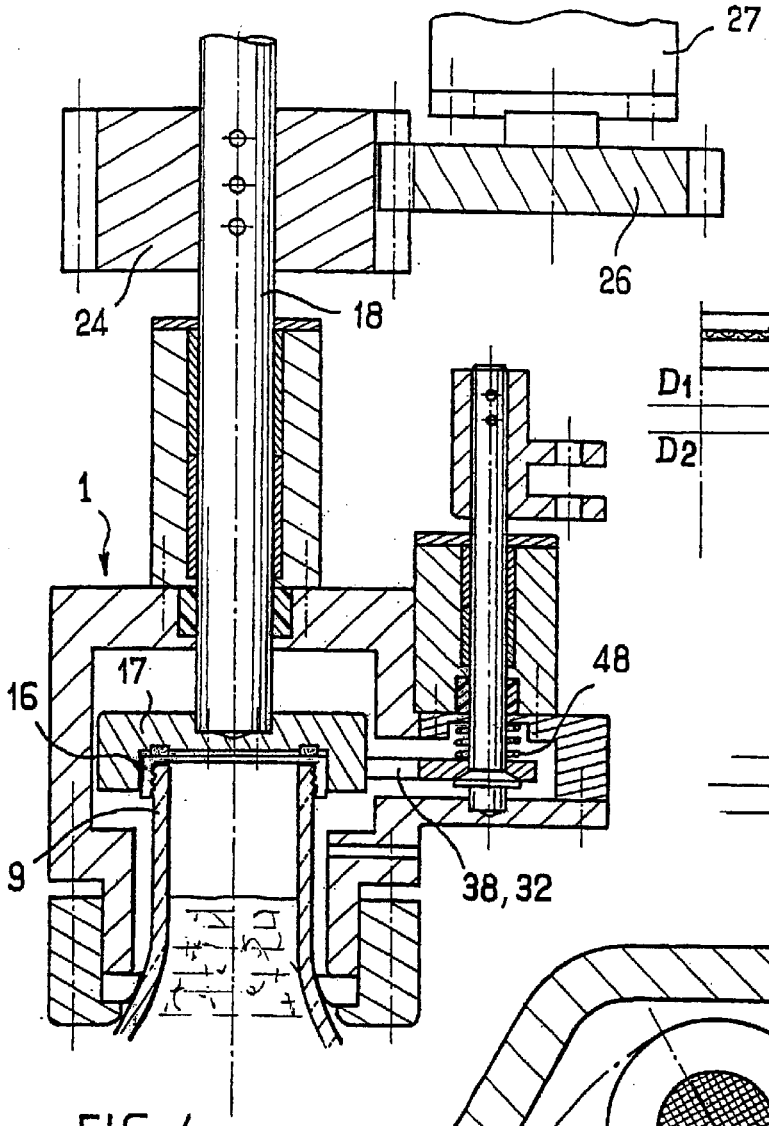
FIG. 4 is a similar view to FIG. 1, but representing the sealing operation.
Figure 2:
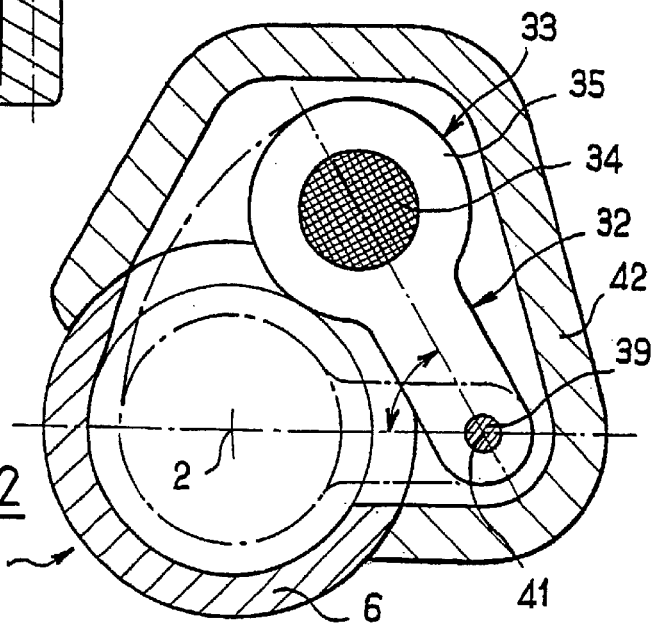
FIG. 2 is a cross section along II—II of FIG. 1.

The cleanliness element 32 is moveable between the active position represented in FIG. 1 and the retracted position represented in FIG. 2. In the active position, the ring 33 is aligned with axis 2 below the armature 17 in a position of readiness, and the sealing element 36 is in contact with the free edge 28 when the bell-shaped element is in the closed position. The aforementioned gap E is sufficient for the cleanliness element 32 to occupy the active position which has just been described and is able to carry out its movement towards the retracted position. In the retracted position (FIG. 2), the ring 33 is off-centre with respect to axis 2 whilst being in the same plane perpendicular to axis 2 as in the active position, and it thus allows the sealing device and in particular the armature 17 to cooperate with the neck of the container 9 as represented in FIG. 4.

For its movement between the active and retracted positions, the cleanliness element 32 comprises an actuating arm 38 integral with the body 35 and extending radially towards the exterior from the circumference of the latter. At a distance from the ring 33, the arm 38 is integral with rotation to an articulation and actuating shaft 39 that extends according to an articulation axis 41 parallel to axis 2 and at a distance from it. The arm 38 and its connection to the actuating shaft 39 are housed in a casing 42 fixed to the body 6 of the bell-shaped element 1. The internal space of the casing 42 is part of the vacuum enclosure. The actuating shaft 39 leaves this enclosure via a guide tube 43 fixed to the casing 42. The tube 43 defines for shaft 39 a bore equipped with a sealing element 44 and sliding bearings 46. Outside tube 43, the actuating shaft 39 is integral with an actuating lever 47 intended to be articulated, at a distance from axis 41, with the moveable end of an actuating jack, which is not further represented.

The actuating shaft 39 can slide with the cleanliness element 32 along axis 41 with respect to the bell-shaped element 41. This assembly 32 and 39 is returned to an extreme position by a compression spring 48 in the direction of the free edge of the bell-shaped element 1. In the presence of a container 9 when the bell-shaped element 1 is closed, the free edge 28 of the container pressed on the sealing element 3 gently pushes the cleanliness element 32 and with it the actuating shaft 39 in an opposite direction to seal 3 with compression of the return spring 48, as indicated in FIG. 1 by displacement d.

The operations of the device and at the same time the process according to the invention will now be described.

While a container 9*a* is delivered into a position of co-axiality with the vertical axis 2 of the device, the armature 17 of the sealing device is re-supplied with a new cap 16 by means which are known and not represented, while the cleanliness element 32 was in retracted position. Then, during the end of the horizontal delivery of the container 9*a* and/or during the start of the vertical movement 7 closing the bell-shaped element 1, the cleanliness element 32 is brought into an active position (FIG. 1) in such a way that the free edge 28 of opening 12 meets the sealing element 36 when the outer side wall of the container 9, reaching position 9*b*, makes contact with seal 3 lining the free edge of the bell-shaped element 1. The vacuum source is then activated so as to evacuate the air from the enclosure 11 via opening 13. The air contained in container 9 is evacuated via the opening 12 and the sieve 34, without being able to bypass it thanks to sealing element 36. The solid content 49 of the container 9 is prevented from leaving the container 9 due to the sieve 34 and to the sealing element 36 which, at the same time, prevents any solid particles or debris from settling on the free edge 28 constituting the future surface of the seal.

Figure 3:
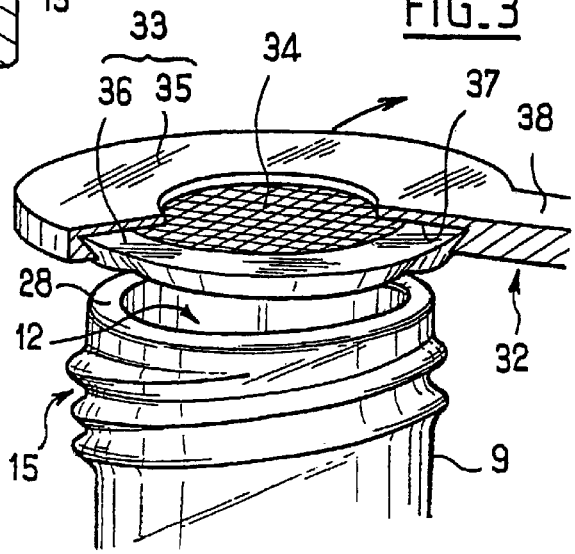
FIG. 3 is a partial perspective view showing the wiping movement, with a cross section of the ring for greater clarity.

When the desired vacuum (in general of the order of $5\times10^4$ Pa) is reached, the actuating jack of shaft 39 is activated so as to move the cleanliness element 32 to the retracted position following a movement that is illustrated in FIG. 3, in the plane of the free edge 28. This movement produces a wiping of the free edge 28 by the sealing element 36. In the retracted position represented in solid lines in FIG. 2, the cleanliness element 32 completely clears the free edge 28 and its immediate environment to allow, as represented in FIG. 4, the action of the sealing device 17, 18 and consequently placeing of the sealing cap 16 on the neck of the container 9.

Then, atmospheric pressure or optionally a slight overpressure to displace the capped container is reestablished in space 11, then movement 7 is carried out in the direction of the opening of the bell-shaped element 1 whilst the moveable assembly 17, 18, 24 of the sealing device returns to the position of readiness represented in FIG. 1. The armature 17 is provided with a new cap 16 for the next container to be sealed and the described cycle recommences.

The body 35 of the ring 33 and the arm 38 of which it is an integral part can be produced in metal. The sieve 34 is preferably constituted by a metallic sieve with a transversal pore size equal to approximately 100 to 500, preferably approximately 250 $\mu$m. The sealing and pressing element 36 can be produced for example in foam or rubber. Foam is preferred in order to avoid the risk of adherence on the free edge 28 of the container.

Figure 5:
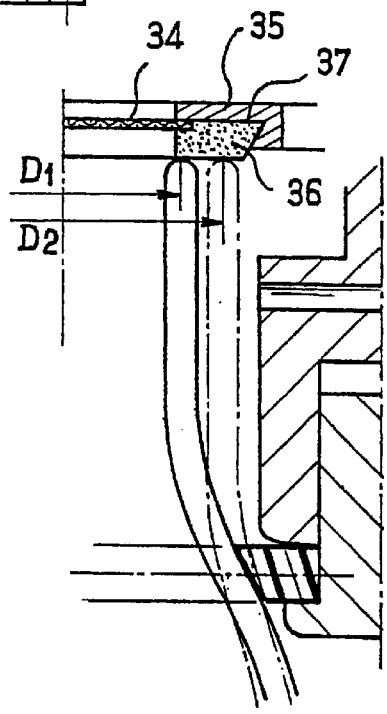
FIG. 5 is a view of a detail of FIG. 1 on a larger scale, illustrating the ability of the ring to cooperate with two bottle sizes.

It is advantageous that, as represented in FIG. 5, the radial width of the sealing element 36 is sufficient to be compatible with at least two types of different containers, distinguished by different diameters D1 and D2 of their free edge 28.

FIG. 2 illustrates the angular travel of the cleanliness element 32 which can typically be of the order of 60°.

Of course, the invention is not limited to the examples described and represented.

In an embodiment where the function of wiping is the only one sought, a long wiper passing from one side to the other of the opening of the container could be used, sweeping all of the free edge after creation of the vacuum and before fitting the cap.

In another embodiment where it is sought above all to avoid depositing debris on the seal surface, a ring can simply be placed over it, during the creation of the vacuum, which is then moved away by a movement moving away from the plane of the free edge, precisely in order to avoid the wiping movement and the wear by rubbing which would result from it in a manner which in this case would be pointless.

And if only sieving is required it is sufficient to place a grille approximately against the free edge of the opening but without particular means sealing the edge of the opening, if only an approximate retention of the solid elements inside the container is thought to be sufficient.

The seal such as 3 could be replaced by an expandable seal.

Instead of permanent magnets, the armature such as 17 can comprise another means of gripping a cap to be placed on the container, for example mechanical means.

What is claimed is:

1. A method for packing in a container, a solid substance consisting of solid loose elements, comprising the following steps:

while the container filled with said substance is in an enclosure, evacuating air from said enclosure, and from said container via an opening of said container;

wiping a free edge of said opening with a cleanliness element, moving thereby to clear any fragment or debris away from said edge; and sealing said container, said sealing including applying a closure element into sealing contact with said edge.

2. A method according to claim 1, wherein said wiping is produced by rotation of a wiping element around an axis which is spaced apart from and approximately parallel to a central axis of the container.

3. A method according to claim 1, wherein the container is a bottle.

4. A method according to claim 1, comprising the further steps of:

placing a protection ring in an active position onto said free edge of said opening during said evacuating; and performing said wiping by moving said ring from the active position into a retracted position along a plane in which said edge extends.

5. A method according to claim 4, wherein said evacuating of air from said container is performed through a sieve supported by said ring forming a mount for the sieve.

6. A method according to claim 4, wherein after said sealing, said enclosure is opened and the ring is returned to the active position while a next container is introduced into enclosure.

7. A method according to claim 4, wherein a force is exerted on the ring when the ring is in the active position and during wiping, said force directed towards the container.

8. A device for sealing a container under vacuum, comprising:

a vacuum bell-shaped element combined with a suction means;

a support for the container;

means of relative displacement between the bell-shaped element and the support between an open position allowing introduction of a container to be sealed and a closed position in which a sealed enclosure is created about the introduced container;

a sealing apparatus supported within the bell-shaped element for applying a closure element in sealing contact with an edge surrounding said opening of the container;

a cleanliness element which is moveable inside the bell-shaped element between an active position adjacent to said edge when the bell-shaped element is in the closed position, and a retracted position allowing sealing; and means for holding the cleanliness element in contact with said edge of the container independently of the sealing apparatus during movement from the active position towards the retracted position thereby to wipe said edge.

9. A device according to claim 8, wherein the circular element has a sufficient radial dimension to fit over at least two diameters of different openings.

10. A device according to claim 8, wherein said means for holding the cleanliness element in contact comprises an elastic means operatively mounted between the cleanliness element and the bell-shaped element in such a way that the cleanliness element is biased towards an open edge of the bell-shaped element.

11. A device according to claim 8, wherein said means for holding the cleanliness element in contact comprises means for urging the cleanliness element into contact with said edge of the container.

12. A device according to claim 8, wherein the container is a bottle.

13. A device according to claim 8, wherein the cleanliness element comprises a ring provided with a circular element which is in contact with a whole annular extent of said edge of the container when the cleanliness element is in the active position.

14. A device according to claim 13, wherein the cleanliness element comprises an arm extending radially outside from the ring and pivoted relative to the bell-shaped element about an axis approximately perpendicular to a plane of said edge of the opening.

15. A device according to claim 13, wherein a sieve is supported by the ring so as to extend radially inside thereof.

16. A device according to claim 15, wherein the sieve has pores of approximately 100 to 500 $\mu$m.

* * * * *